United States Patent [19]

Holz et al.

[11] Patent Number: 4,575,716

[45] Date of Patent: Mar. 11, 1986

[54] METHOD AND SYSTEM FOR OPERATING A DISPLAY PANEL HAVING MEMORY WITH CELL RE-IGNITION MEANS

[75] Inventors: George E. Holz, North Plainfield; James A. Ogle, Neshanic Station, both of N.J.

[73] Assignee: Burroughs Corp., Detroit, Mich.

[21] Appl. No.: 525,283

[22] Filed: Aug. 22, 1983

[51] Int. Cl.[4] ..... G09G 3/02

[52] U.S. Cl. ..... 340/714; 340/776; 340/805

[58] Field of Search ..... 340/714, 758, 776, 793, 340/805, 813; 315/169.1, 169.2, 169.4

[56] References Cited

U.S. PATENT DOCUMENTS

| | | | |
|---|---|---|---|
| 3,919,591 | 11/1975 | Criscimagna | 340/776 |
| 4,067,047 | 1/1978 | Ryan | 340/805 |
| 4,104,563 | 3/1978 | Schlig et al. | 340/805 |
| 4,329,616 | 5/1982 | Holz et al. | 340/714 |
| 4,373,157 | 2/1983 | Holz et al. | 340/805 |
| 4,378,556 | 3/1983 | Wisnieff | 340/805 |
| 4,386,348 | 5/1983 | Holz et al. | 340/714 |
| 4,415,892 | 11/1983 | Marentic | 340/805 |

*Primary Examiner*—Gerald L. Brigance
*Assistant Examiner*—Jeffery A. Brier
*Attorney, Agent, or Firm*—Mark T. Starr; Kevin R. Peterson

[57] ABSTRACT

In a display panel comprising a gas-filled envelope containing at least two arrays of electrodes defining gas-filled cells, at least one array of electrodes is insulated from the gas and comprises A.C. electrodes. If the panel is turned off for any length of time with display information contained therein, the information can be re-displayed by applying special pulses during a re-ignition period and then applying normal sustaining pulses during the normal display period.

11 Claims, 9 Drawing Figures

140
114
110
120
100
30
132
94
142
86
10
92
88
150
80
2
50
40
50
74
61
74
22
61
60
70
64
60D
60C
60B
60A
62
50
2
40
20

METHOD AND SYSTEM FOR OPERATING A DISPLAY PANEL HAVING MEMORY WITH CELL RE-IGNITION MEANS

BACKGROUND OF THE INVENTION

A new type of display panel having memory is described in U.S. Pat. No. 4,386,348, dated May 31, 1983, of George E. Holz and James A. Ogle. The panel comprises a gas-filled envelope including a layer of D.C. scan/address cells and a layer of quasi A.C. display cells. The scan cells are arrayed in rows and columns, and the display cells are arrayed in corresponding rows and columns. The scan cells are scanned and turned on column-by-column by operation of their electrodes while sustain signals are simultaneously being applied to the display cells, and the same electrodes are used to transfer information from selected scan cells to the associated display cells where glow is sustained by the sustainer signals. The cells which are energized in the entire panel, by this routine, display a stationary but changeable message.

In one mode of operation of these panels described and claimed in an application Ser. No. 525,282 entitled SYSTEM AND METHOD FOR OPERATING A DISPLAY PANEL HAVING MEMORY, filed concurrently herewith by George E. Holz and James A. Ogle, the panel is operated and displays a message. Then, at some time, it is, in effect, turned off while information which is in the panel is erased or while new information is written into the panel, and then it is turned on again to display the new information. If the panel is held off for too long a time before it is turned on again, it may not come back on properly and some information may be lost. The present invention solves this problem, and it also permits turning off a panel having a message contained in it and then turning on the panel minutes later without losing the message. Thus, whenever cell re-ignition is required, the present invention can be employed.

DESCRIPTION OF THE INVENTION

The present invention comprises an electronic system used with a display panel of the type described and claimed in the above-identified patent, which is incorporated herein by reference.

Figure 1:
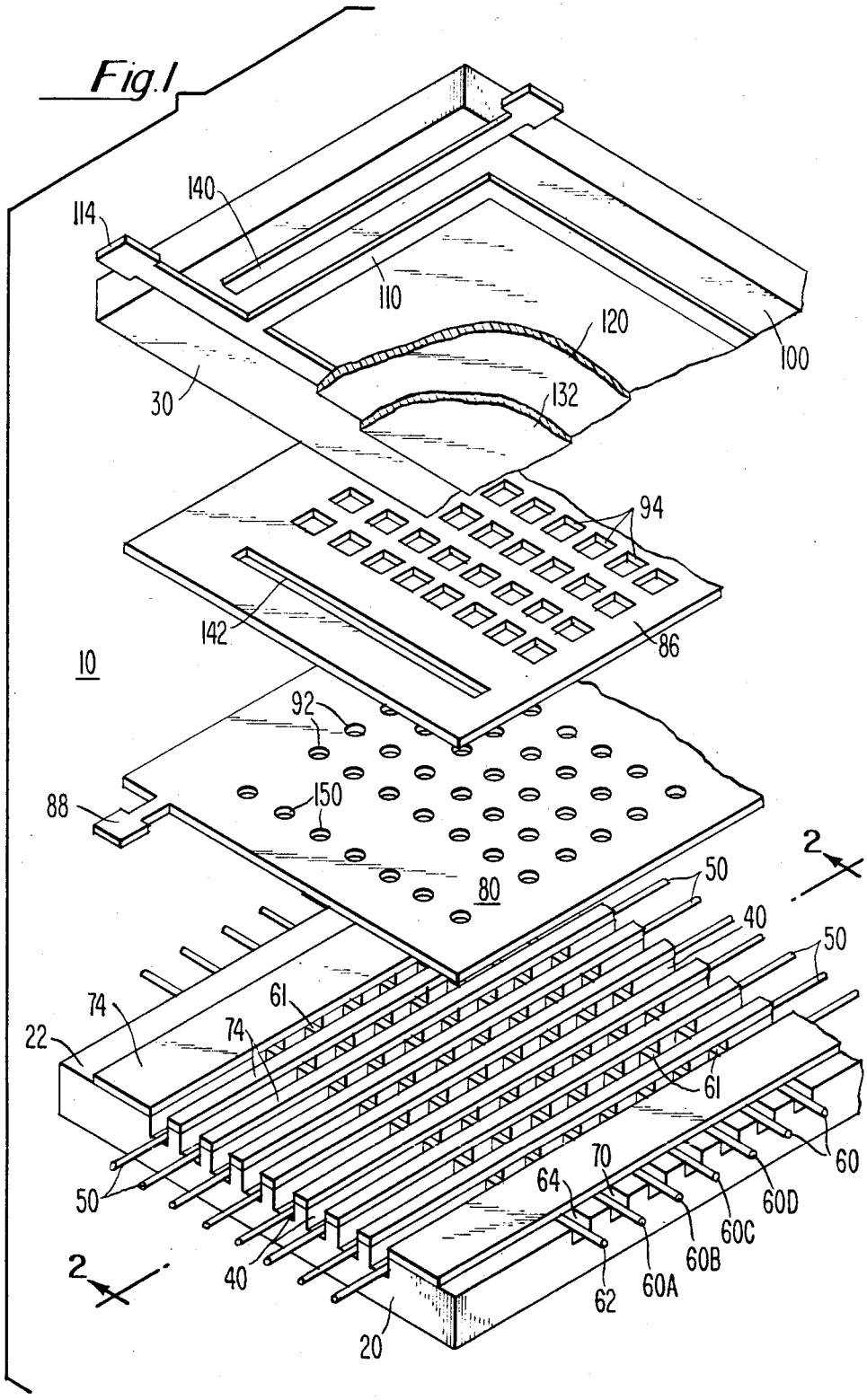
FIG. 1 is a perspective exploded view of a display panel operated according to the invention.

This display panel 10, shown in the drawings, comprises a gas-filled envelope made up of an insulating base plate 20 and a glass face plate 30, which is shown tilted up and to the left in FIG. 1 to present a view of its inner surface. These plates are hermetically sealed together along their aligned perimeters to provide an envelope which encloses the various gas-filled cells and operating electrodes of the panel. The base plate has a top surface 22 in which a plurality of deep parallel slots 40 are formed and in each of which a scan/address anode electrode 50 is seated and secured.

Figure 2:
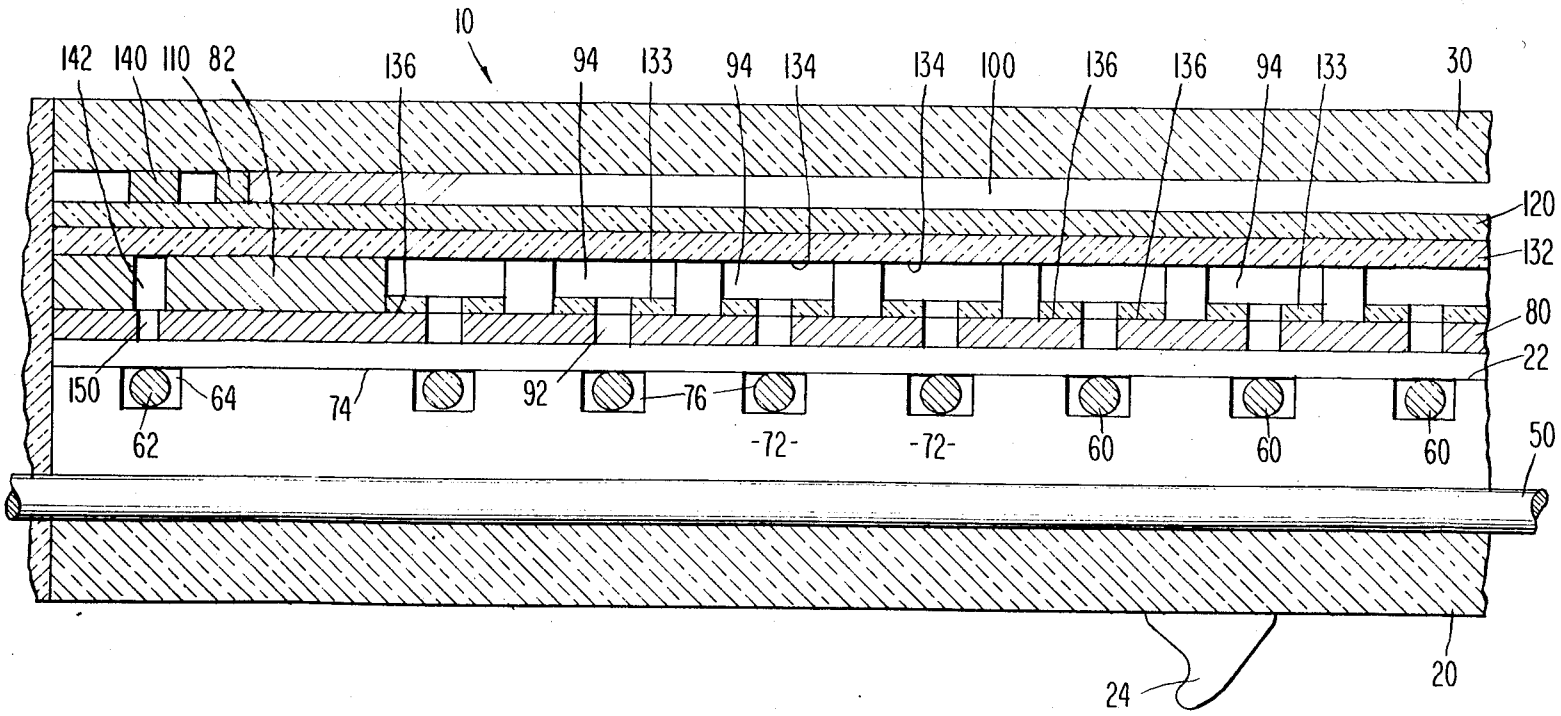
FIG. 2 is a sectional view through the panel of FIG. 1 along lines 2—2, with the panel shown assembled.

A plurality of scan cathode electrodes 60 are seated on the top surface of the base plate or in shallow grooves 70 therein. The grooves 70 and scan cathodes 60 are disposed transverse to the grooves 40 and scan anodes 50, and each crossing of a scan cathode 60 and scan anode 50 defines a scanning cell 72 (FIG. 2). It can be seen that the anodes 50 and cathodes 60 form a matrix of scanning cells which are arrayed in rows and columns. More specifically, the cathode portions 61, the underlying portions of anodes 50, and the intermediate gas volumes define the scanning cells.

The scan cathodes 60A, B, C, etc., form a series of cathodes which can be energized serially in a scanning cycle, with cathode 60A being the first cathode energized in the scanning cycle.

A reset cathode electrode 62 is disposed on the base plate or in a groove 64 therein adjacent to the first scan cathode 60A, so that, when it is energized, it provides excited particles for cathode 60A at the beginning of a scanning cycle to be described. Where the reset cathode crosses each scan anode 50, a reset cell is formed, and the crossing of all of the scan anodes by the reset cathode provides a column of reset cells. These reset cells are turned on or energized at the beginning of each scanning cycle, and they expedite the turn-on of the first column of scanning cells associated with cathode 60A.

The panel 10 includes a keep-alive arrangement which is described below and in U.S. Pat. No. 4,329,616 of George E. Holz and James A. Ogle, which is incorporated herein by reference.

In the panel 10, spacer means comprising strips 74 of insulating material, such as glass, are provided on the top surface of the insulating plate 20 between slots 40 and crossing cathodes 60 and 62 so that the cathodes are spaced uniformly from an electrode plate 80 (known as the priming plate) disposed above them, as described below. The strips 74 are disposed across the cathodes 60 which are thus separated into the discrete operating portions 61.

The portions of the panel described up to this point comprise the base plate assembly. This is the D.C. portion and the scanning and addressing portion of the panel 10 in which the electrodes are in contact with the gas in the panel.

Adjacent to the base plate assembly is the second portion of the panel which is a quasi A.C. assembly; that is, it includes electrodes which are insulated from the gas in the panel, and electrodes which are in contact with the gas. This portion of the panel includes electrode 80 which is in the form of a thin metal plate having an array of rows and columns of relatively small apertures 92, each overlying one of the scanning cells. The plate 80 is positioned close to cathode 60 and may be seated on insulating strips 74. Plate 80 is known as a priming plate.

Adjacent to plate 80, and preferably in contact with the upper surface thereof, is an apertured plate 86 (known as the glow isolator) having rows and columns of apertures 94 which are larger than apertures 92. The apertures 94 comprise the display cells of panel 10. The sheet 86 may be of insulating material, or it may be of metal, and, if it is of metal, the plates 80 and 86 may be made in one piece. Plate 80 is provided with a tab 88, to which external electrical contact can be made.

The quasi A.C. assembly also includes a face plate assembly which includes a single large-area transparent conductive electrode 100 on the inner surface of the plate 30. A narrow conductor 110, which outlines and reinforces the electrode layer 100 in conductive contact, serves to increase its conductivity, if necessary. The conductor 110 includes a suitable tab 114, to which external connection can be made. The large-area electrode 100 is of sufficient area to overlie the entire array of display cells 94 in plate 86. An insulating coating 120 of glass or the like covers electrode 100, and this layer 120 is coated with a low work function refractory layer 132 of magnesium oxide, thorium oxide, or the like.

In panel 10, the apertures 94 in plate 86 comprise display cells, and, as can be seen in FIG. 2, each display cell has one end wall 134 formed by a portion of insulating layer 132, and an opposite end wall 136 formed by a portion of the top surface of plate 80. To provide cell uniformity and to minimize sputtering, a coating of the material of layer 132 should also be provided on the base or lower wall 136 of each display cell 94, such as the layer 133 shown in FIG. 2.

At the present time, it appears that optimum operation of the panel is achieved if the apertures or cells 94 are unsymmetrical in that insulating layers 120 and 132 together have a thickness greater than layer 133. Indeed, layer 133 may even be thinner than layer 132. Thus, the lower end wall 132 of each cell 94 will have a very high capacitance coupling to the cell, and layer 133 will consequently tend to form only a minimal wall charge in the operation described below. In one mode of construction, both layer 132 and layer 133 may be formed by an evaporation process, and layer 133 may be so thin that it is not completely continuous, which is a desirable quality. In any case, however, the character of this wall of the cell is affected by the aperture 92 in the metal plate 80.

The gas filling in panel 10 is preferably a Penning gas mixture of, for example, neon and a small percentage of xenon, at a pressure of about 400 Torr. When the panel has been constructed and evacuated, the gas filling is introduced through a tubulation 24 secured to base plate 20 (FIG. 2), or a non-tubulated construction can be employed.

The keep-alive arrangement, in panel 10, includes an A.C. electrode 140 in the form of a line-like conductive film or layer of an opaque metal, such as silver, provided on the inner surface of the face plate 30 adjacent to one edge of the transparent conductive electrode 100. The A.C. keep-alive electrode 140 is positioned so that, in the completed panel, it overlies the column of reset cells and reset cathode 62, to which it supplies excited particles. The A.C. keep-alive electrode 140 is covered by the insulating layers 120 and 132. In this keep-alive arrangement, the plate 86 is provided with a slot 142, and plate 80 is provided with a column of holes 150. The slot 142 overlies and is aligned with the column of holes 150, and both lie beneath and are aligned with the A.C. electrode 140 so that, in effect, the electrode 140, slot 142 and holes 150 form a sandwich. The slot 142 in the plate 86 is narrower than the opaque A.C. electrode 140 so that a viewer, looking through face plate 30, cannot see any glow which is present in slot 142 and holes 150. Electrode 140 operates with plate 80 to produce glow discharge between them and produce excited particles in slot 142 and holes 150. These excited particles are available to the reset cathode 62 and assist the firing of the column of reset cells.

Systems for operating panel 10 are described in the above-identified U.S. Pat. No. 4,386,348 and in U.S. Pat. No. 4,315,259, of Joseph E. McKee and James Y. Lee, which is also incorporated herein by reference. Some of the principles of these systems are useful in the system described below.

Figure 3:
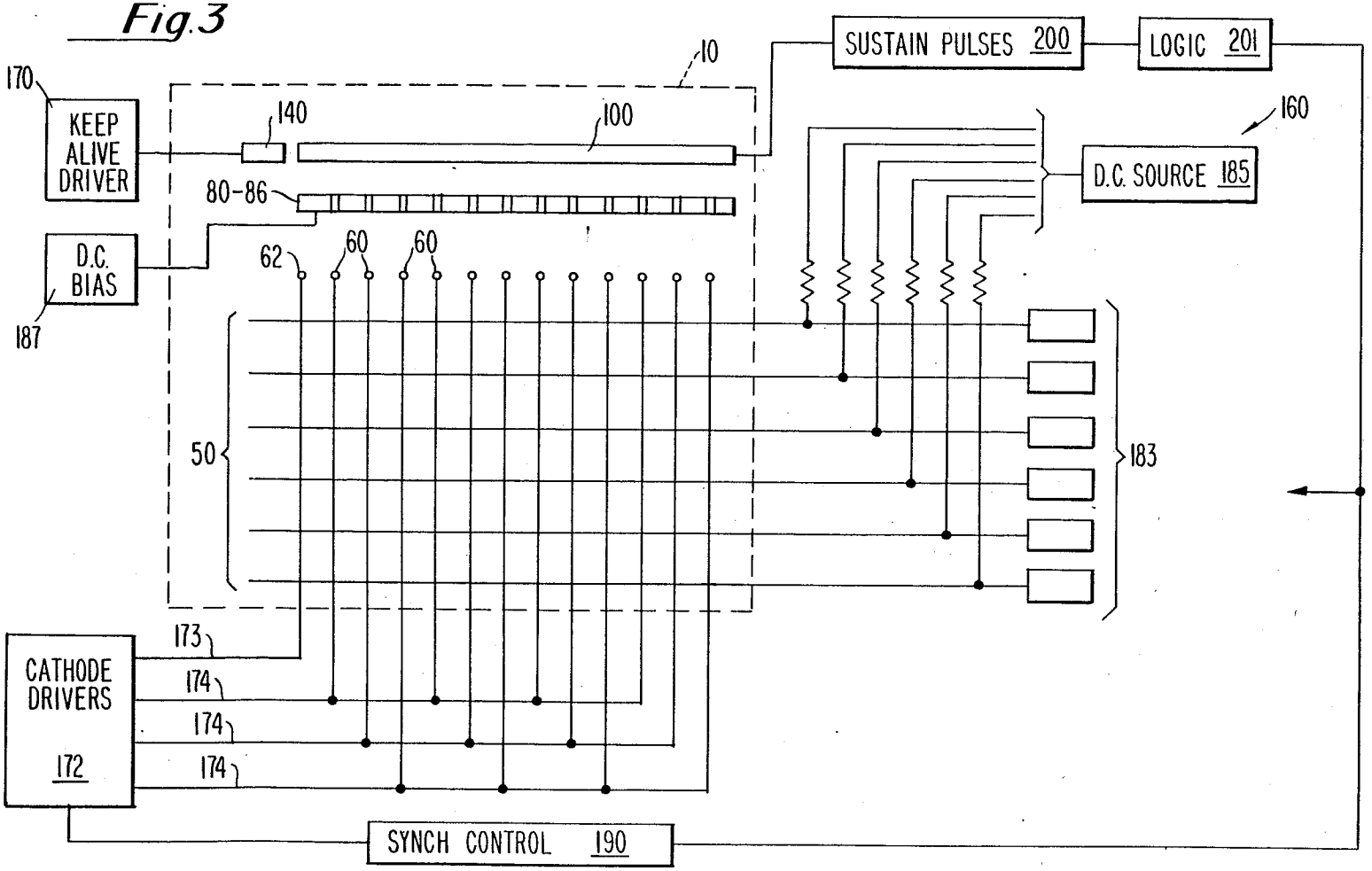
FIG. 3 is a schematic representation of the panel of FIG. 1 and an electronic system in which it may be operated.

A schematic representation of the display panel 10 and an electronic system 160, according to the invention, for operating the panel are shown in FIG. 3. The circuit includes a keep-alive driver 170, which provides an A.C. signal, suitably coupled to keep-alive electrode 140. The system also includes module 172 which comprises a series of serially energizable drivers for providing a negative reset pulse for reset cathode 62 on lead 173 and a series of negative scan cathode pulses for cathodes 60 on leads 174. The scan cathodes 60 are connected in groups or phases, with each group including any suitable number of cathodes such as three or four or six, or more, as desired. Grouping of cathodes in this way is now well known in the SELF-SCAN panel art. The scan phase drivers in module 172 are sequentially activated so as to energize each of the cathodes 60 in consecutive sequence along the "X" axis of the panel.

A D.C. power source 185 is coupled through a resistive path to each of the scan anodes 50. In addition, separate data drivers 183, each of which represents a source of write pulses and erase pulses, are coupled, one to each scan/address anode 50.

A source 187 of D.C. bias potential is coupled to priming plate 80, and a source 200 of A.C. sustainer signals, is connected to the transparent conductive layer 100.

Suitable timing and synchronizing circuits 190 are provided as required.

The operation of display panel 10, as described in the above-identified U.S. Pat. No. 4,386,348, is generally as follows. With the keep-alive mechanism energized by source 170 and generating excited particles, and with operating potential applied to the scan anodes 50 from source 185, the reset cathode 62 is energized to fire the column of reset cells, and then the scan cathodes 60 are energized sequentially by operation of driver module 172 to carry out a scanning operation in the D.C. scan portion and scan cells 72 of the panel 10. At the same time, with A.C. sustaining pulses applied from source 200 to the electrode 100, as each column of scan cells is energized, negative write or display pulses are applied from one or more selected driver modules 183, in accordance with input data and with proper timing with respect to the sustaining pulses, to the selected scan anodes.

Under these conditions, if the data or address signals from a source 183 direct that a particular display cell be turned on, when the column containing the scan cell beneath that display cell is being scanned, that scan cell is momentarily turned off, in synchronism with, and during, the application of a positive sustainer pulse to the electrode 100, and the cell is then turned back on, so that the scanning operation can proceed normally. During the period when this scan cell is turned off, and its discharge is in the process of decaying, a positive column is drawn to electrode 80 and electron current flows from its electrode portion 61 to electrode 80, and electrons are drawn through the aperture 92 in electrode 80 into the selected display cell 94 by the positive sustainer pulse. This combination of effects, with some current multiplication probably occurring in the display cell, produces a negative wall charge on wall 134 of the selected display cell, and the combination of the voltage produced by this wall charge and the voltage of the next negative sustainer pulse produces a glow discharge in the selected display cell. This discharge, in turn, produces a positive wall charge on wall 134, which combines with the next positive sustainer pulse to produce a glow discharge, and, in similar manner, successive sustainer pulses produce successive discharges and consequent visible glow in the selected cell.

After all cell columns have been scanned and the desired display cells have been turned on, the sustainer pulses keep these cells lit and the written message displayed.

The erasing operation is generally similar to the writing operation described above. In erasing, as in writing, the selected display cell is operated upon while its underlying scan cell is being scanned, but the erase signal is applied in synchronism with, but following, the negative sustainer pulse. For the erase operation, the associated scan cell is again turned off momentarily, and then it is turned back on, to avoid interfering with the normal column-by-column scan of the scan cells. While it is off, the decaying discharge around electrode portion 61 again produces electron flow to electrode 80, and through the aperture in that electrode into the display cell. This serves to remove, or neutralize, the positive charge then on wall 134 of the display cell (which charge was produced by the most recent negative sustainer pulse) so that the next sustainer pulse will fail to produce a glow discharge, and glow discharge, or display, in the selected cell will cease.

A logic circuit 201 is coupled to sustainer pulse generator 200 for performing the operations described below.

Figure 4:
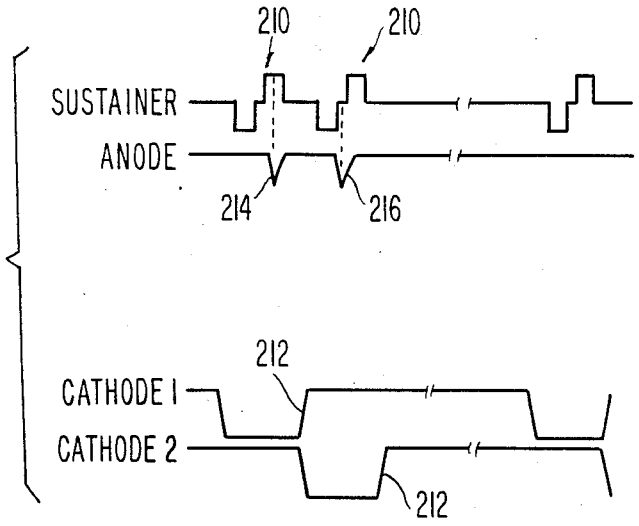
FIG. 4 is a representation of some waveforms used in operation of the system of the invention.
Figure 6:
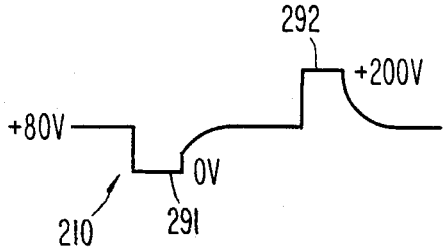
FIG. 6 shows a typical sustainer pulse generated by the circuit of FIG. 5.
Figure 5:
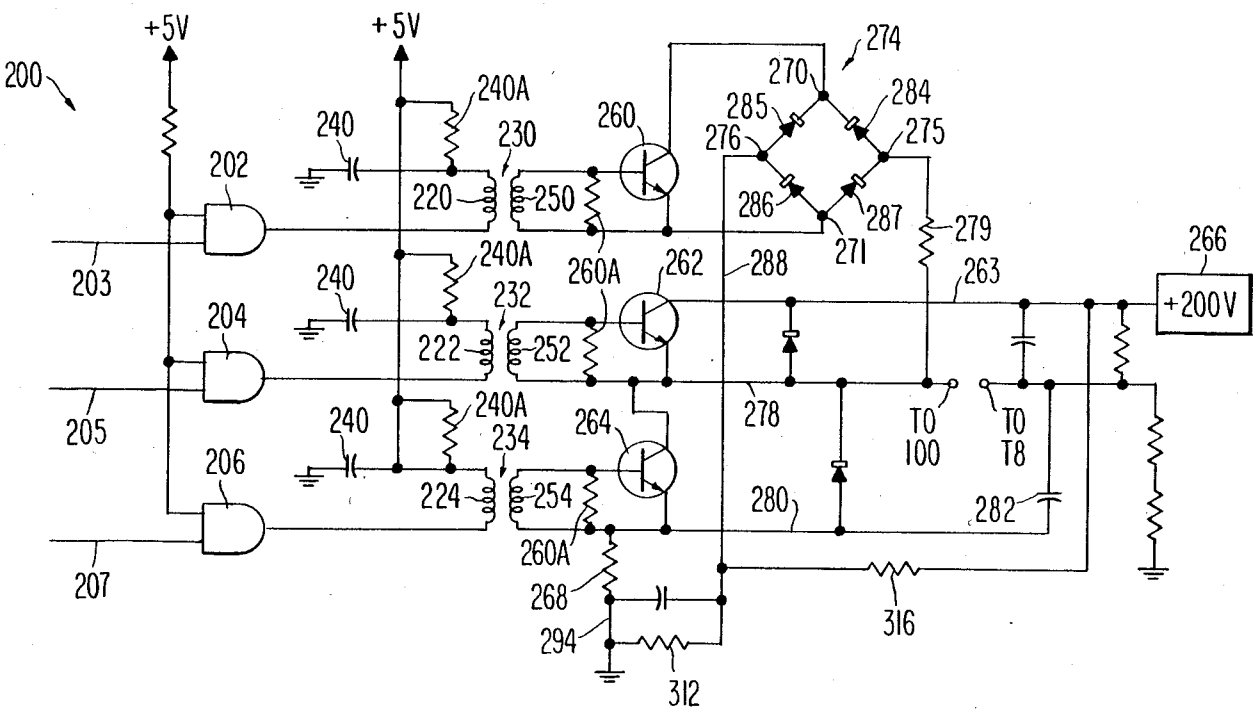
FIG. 5 is a schematic representation of a circuit for generating sustainer pulses used in practicing the invention.

FIG. 4 shows some of the waveforms used in carrying out the foregoing operation. These waveforms include sustainer pulses 210, write and erase pulses 192 and 194, respectively, and their relationship to the sustainer pulses, and the turn-on signals 196 applied to two successive cathodes in a scanning cycle. A circuit such as that shown in FIG. 5 can be used to provide the sustainer signals 210 (FIG. 6) and other sustainer signals to be described. The circuit is shown in the above-cited U.S. Pat. No. 4,315,259 of McKee and Lee. In operation of this circuit, the turn-on pulses for the circuit 200 are controlled by appropriate logic in source 201 to obtain the desired frequency and wave shape.

To generate sustainer pulses, control circuit 190 operates logic circuit 201 to first apply a turn-on pulse to AND gate 206, the output of which, operating through transformer 234, turns on transistor 264. Transformer 234 performs signal level shifting and provides base current to turn on transistor 264 and a low base impedance to assist in the turn-off of transistor 264. The turn-on of transistor 264 generates the negative-going pulse 291 (FIG. 6) at lead 278 which reaches a level of about zero volts.

After the desired time duration for pulse 291, AND gate 202 receives a turn-on pulse which operates through transformer 230, like transformer 234, to turn on transistor 260, and this generates current flow through the diode bridge 274 to return the sustaining pulse to the 80 volt level. Next, AND gate 204 receives a turn-on pulse, and its output turns on transistor 262 which generates the positive pulse 292 of the sustaining signal to a level of about 200 volts. Finally, AND gate 202 receives another pulse to turn on transistor 260 again to generate the negative-going portion of the sustaining signal back to the 80 volts level by way of the diode bridge 274.

It is noted that transistor 260 performs a dual function in switching the sustaining signal either from 200 volts to the reference level of 80 volts or from zero volts to the reference level of 80 volts. The positive or negative transition of the switching operation of transistor 260 is determined by the sustain output voltage level prior to switching and the resultant path through the diode bridge 274. If the sustain output level is at 200 volts, the turn-on of transistor 260 will cause the sustain output to switch in a negative direction to 80 volts due to the low impedance path to the 80 volt bus 288 by way of resistors 279, diode 284, transistor 260, and diode 286. Diodes 285 and 287 are open circuited. Likewise, if the sustain output level is at zero volts, the turn-on of the transistor 260 will cause the sustain level to switch in a positive direction along a low impedance path to the 80 volt bus 388 by way of resistor 279, diode 287, transistor 260, and diode 285, with diodes 284 and 286 being open circuited.

Those skilled in the art will see that circuit 200 can be readily operated as required to provide the sustainer pulses to be described below.

The present invention relates particularly to a mode of operation of panel 10 wherein the panel is either turned off entirely for a period of time or it is operated at a low level of brightness for a period of time. One mode of operation of this type is described and claimed in the application entitled SYSTEM AND METHOD FOR OPERATING A DISPLAY PANEL HAVING MEMORY, filed concurrently herewith. In one mode of operation described in that application, information is written into the panel or erased while the panel is, in effect, turned off and a steady sustainer signal is applied. The present invention provides re-ignition of the panel without loss of information during this write or erase period.

Figure 7:
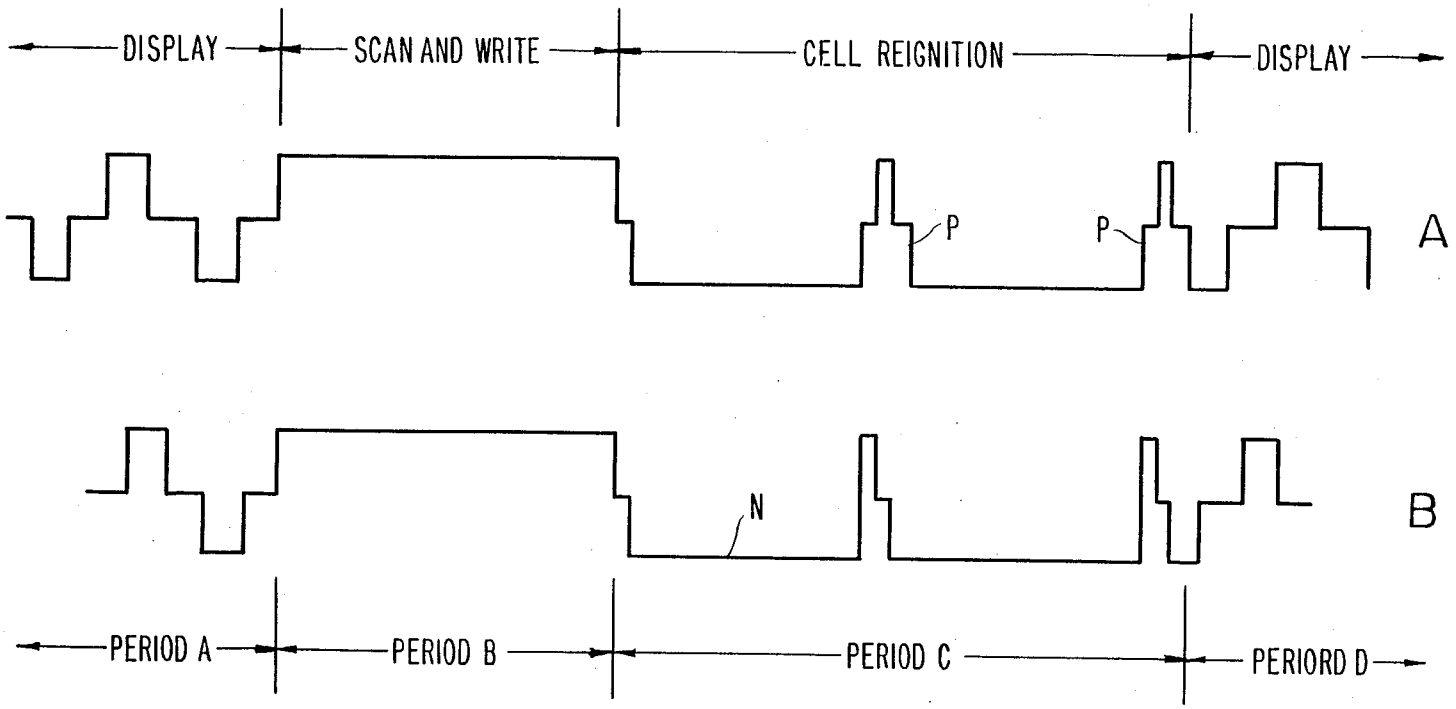
FIG. 7 (A and B) are representations of sustainer waveforms used in practicing the invention.

In this mode of operation, illustrated in FIG. 7, during period A, the display panel is displaying information with sustainer signals being applied at a suitable frequency. Then, when information is to be written into the panel, the sustainer pulses are discontinued and a positive steady sustainer signal is applied to the entire panel (period B) to permit cells to be addressed and information to be set into the panel. During this period of time, period B, the columns of scan cells are cycled through and selected display cells are addressed and written, this operation being carried out at high speed, of about 10 milliseconds or less to minimize flicker.

According to the invention, to minimize flicker and to achieve optimum turn-on of the information in the panel, a cell re-ignition time period C is provided following the scan and address time period B, and this is followed by period D in which normal display is achieved by the application of the "normal" sustainer signals, as in period A, to retain the message set into the panel during period B. In waveform A, in the re-ignition period, the sustainer signal includes a steady negative sustainer level following the scan period B and having one sustainer pulse P, from negative to positive to negative, in the middle of the period and a similar pulse P at the end of the period. The waveform B in FIG. 7 appears to be optimum for cell re-ignition at the present time and is similar to the waveform A; however, elimination of the return-to-center portion of the inserted pulses P following the positive-going portion of the P provides improvement in re-ignition. The theory is that the relatively long negative period N gives cells an opportunity to re-fire and these cells have an opportunity to fire again at the top of pulse P. In waves A and B, one pulse P may be sufficient or more than two may be used.

It is noted that the cell re-ignition period has a time duration of one to four milliseconds.

Of course, other signal routines can be inserted after the re-ignition period as described in the concurrently filed application.

It is noted that the cell re-ignition period is required in some modes of operation and for some panels, since some of the display cells which are selected during the addressing period B may not be re-ionized and turned on after the off-time of the scan time slot, period B. The apparent effect is the loss of some display points following each such scan period. It is believed that these re-ignition failures occur when a cell fires very late in a sustain pulse and has less opportunity, than otherwise, to accumulate wall charge before the sustain signal returns to its center or reference level, after which the already small wall charge is further depleted, thus effectively erasing the cell. Another way of viewing this result is that a late firing is similar in effect to a very short sustain pulse, a classical cell erase technique.

Figure 8:
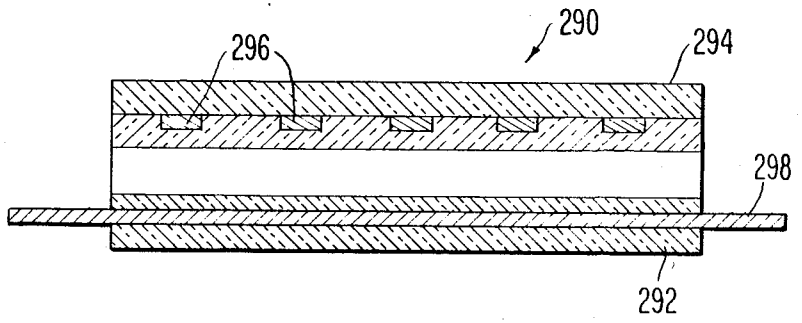
FIG. 8 is a sectional view of another type of panel which can be operated in accordance with the invention.

Those skilled in the art will appreciate that the principles of the invention may be employed to carry out cell re-ignition in gas display panels other than the panel described above. One other specific type of panel is an A.C. plasma panel 290 of the type shown in FIG. 8 and comprising two spaced apart glass plates 292 and 294, each of which carries an array of insulated electrodes, one set of electrodes 296 being disposed transverse to the other array of electrodes 298.

Figure 9:
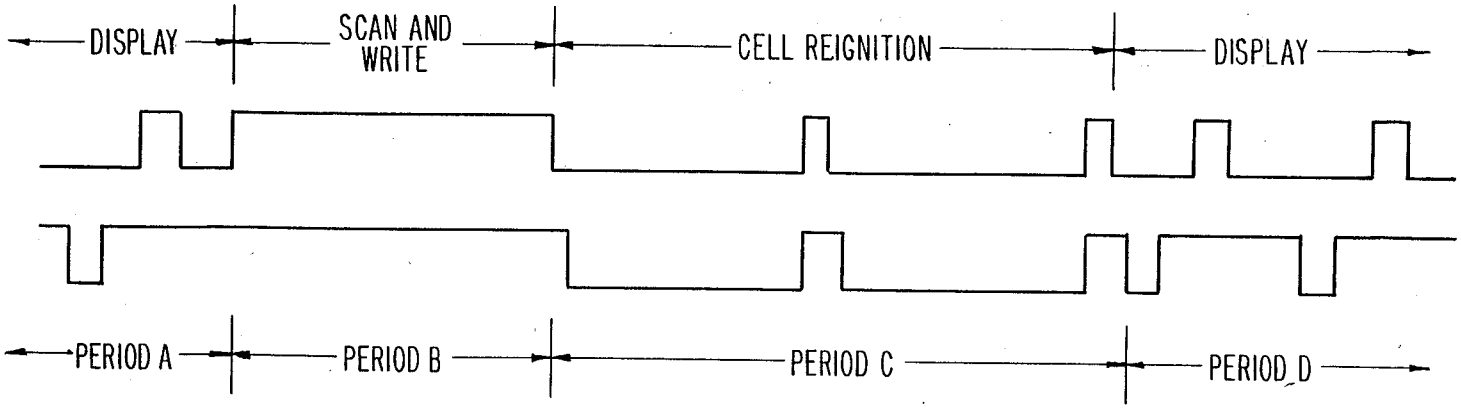
FIG. 9 shows a sustainer waveform used with the panel of FIG. 8.

In operating such an A.C. panel according to the invention, the waveforms described above are split into two generally complementary portions, one applied to one set of electrodes and one applied to the other set of electrodes so that the net effect is to have the desired total voltage variations across the panel Such waveforms are illustrated in FIG. 9.

What is claimed is:

1. A system for operating a display panel with memory wherein the display panel includes a gas-filled envelope, a first layer of D.C. scan cells disposed in rows and columns and including row scan anodes and column scan cathodes which cross each other, with said crossings defining said D.C. cells, an apertured electrode defining rows and columns of display cells, each display cell being in communication with a D.C. scan cell, and an A.C. electrode associated with and insulated from said apertured electrode and operating therewith as the electrodes for said display cells, said system comprising first means coupled to all of said scan anodes for applying operating potential thereto, second means coupled to said scan cathodes for applying operating potential to each cathode in turn to fire and turn on each column of scan cells in turn sequentially, third means coupled to said scan anodes for applying data signals to selected ones of said anodes as its column of scan cells is fired and turned on, fourth means coupled to said apertured electrode and said A.C. electrode for applying sustainer signals thereto, the application of said sustainer signals and said data signals being synchronized so that, when the data signals are applied, glow is generated in the selected display cells associated with the scan anodes to which the data signals are applied, the sustainer signals sustaining the display glow in such selected display cells, and control means coupled to said fourth means for modifying said sustainer signal to include a time period in which the displayed message is in a reduced state of brightness or is completely extinguished, and then modifying said sustainer signal to include a cell re-ignition period after said time period and before the panel is returned to normal display brightness;

said cell re-ignition period being a time period in which a signal is applied to said panel to facilitate return of the panel to normal display brightness.

2. The system defined in claim 1 wherein during said time period said control means is operated to keep said sustainer signal at a constant positive level and the columns of scan cells are scanned sequentially and, simultaneously, data signals are applied to turn on selected associated display cells, and then the control means is operated to provide a sustainer signal having pulses of a frequency suitable to maintain the selected display cells at a selected brightness level.

3. The system defined in claim 1 wherein, in said re-ignition time period, a waveform is applied which comprises a steady negative signal with a positive sustainer pulse inserted therein.

4. The system defined in claim 1 wherein, in said re-ignition time period, a waveform is applied which comprises a steady negative sustainer pulse and a pulse inserted therein which rises directly from the negative level of said negative pulse to a positive level and then falls to reference level for a short period and then falls to said negative level.

5. The method of operating a display panel which includes a gas-filled envelope, a first layer of D.C. scan cells disposed in rows and columns and including row scan anodes and column scan cathodes which cross each other, with the crossings defining said D.C. cells, an apertured electrode defining rows and columns of display cells, each display cell being in communication with a D.C. scan cell, and an A.C. electrode associated with and insulated from said apertured electrode and operating therewith as the electrodes for said display cells, said method comprising applying sustainer signals between said A.C. electrode and said apertured electrode, applying operating potential to all of said scan anodes, applying operating potential to each cathode in turn to fire and turn on each column of scan cells in turn sequentially, applying data signals to selected ones of said anodes as its column of scan cells is fired and turned on, the application of said sustainer signals and said data signals being synchronized so that, when the data signals are applied, glow is generated in the selected display cells associated with the scan anodes to which the data signals are applied, the sustainer signals sustaining the display glow in such selected display cells, and modifying said sustainer signals to apply a steady sustainer signal between said A.C. electrode and said apertured electrode whereby said panel is, in effect, turned off, applying cell re-ignition sustainer signals between said A.C. electrode and said apertured electrode, and applying display sustainer signals between said A.C. electrode and said apertured electrode to display information held in said panel, said cell re-ignition sustainer signals facilitating the return of turned-on cells to normal brightness.

6. The method of operating a display panel comprising a gas-filled envelope containing at least two arrays of electrodes defining gas-filled cells, at least one array of said electrodes being insulated from the gas and comprising A.C. electrodes, the method comprising causing selected cells to turn on and glow to represent the entry of information in the panel and sustaining the display of this information by the application of sustaining signals to said electrodes, discontinuing the display of information for a period of time, applying special sustainer signals to said panel in a cell-re-ignition period to prepare the panel to be brought to normal display brightness, and applying sustainer signals to said panel to display information contained therein, at normal brightness.

7. The method defined in claim 6 wherein said special sustainer signals are pulses of a frequency suitable to maintain the selected display cells glowing at a selected brightness level.

8. The method defined in claim 6 wherein, in said re-ignition time period, a waveform is applied which comprises a steady negative signal with a positive sustainer pulse inserted therein.

9. A system for operating a display panel with memory wherein the display panel includes a gas-filled envelope, a first layer of D.C. scan cells disposed in rows and columns and including row scan anodes and column scan cathodes which cross each other, with said crossings defining said D.C. cells, an apertured electrode defining rows and columns of display cells, each display cell being in communication with a D.C. scan cell, and an A.C. electrode associated with and insulated from said apertured electrode and operating therewith as the electrodes for said display cells, said system comprising first means coupled to all of said scan anodes for applying operating potential thereto, second means coupled to said scan cathodes for applying operating potential to each cathode in turn to fire and turn on each column of scan cells in turn sequentially, third means coupled to said scan anodes for applying data signals to selected ones of said anodes as its column of scan cells is fired and turned on, fourth means coupled to said apertured electrode and said A.C. electrode for applying sustainer signals thereto, the application of said sustainer signals and said data signals being synchronized so that, when the data signals are applied, glow is generated in the selected display cells associated with the scan anodes to which the data signals are applied, the sustainer signals sustaining the display glow in such selected display cells, and control means coupled to said fourth means for modifying said sustainer signal to include a time period in which the displayed message is in a reduced state of brightness or is completely extinguished, and then modifying said sustainer signal to include a cell re-ignition period after said time period and before the panel is returned to normal display brightness, in said cell re-ignition period, there being a steady sustainer signal and at least one pulse of a polarity which can cause the firing of cells containing information and comprising cells which take part in displaying the message contained in the panel.

10. A method of operating a display panel with memory wherein the display panel includes a gas-filled envelope, a first layer of D.C. scan cells disposed in rows and columns and including row scan anodes and column scan cathodes which cross each other, with the crossings defining said D.C. cells, an apertured electrode defining rows and columns of display cells, each display cell being in communication with a D.C. scan cell, and an A.C. electrode associated with and insulated from said apertured electrode and operating therewith as the electrodes for said display cells, said method comprising applying sustainer pulses to said A.C. electrode, applying operating potential to all of said scan anodes, applying operating potential to each cathode in turn to fire and turn on each column of scan cells in turn sequentially, applying data signals to selected ones of said anodes as its column of scan cells is fired and turned on, the application of said sustainer signals and said data signals being synchronized so that, when the data signals are applied, glow is generated in the selected display cells associated with the scan anodes to which the data signals are applied, the sustainer signals sustaining the display glow in such selected display cells, and modifying said sustainer signal to include a time period in which the displayed message is in a reduced state of brightness or is completely extinguished, and then modifying said sustainer signal to include a cell re-ignition period after said time period and before the panel is returned to normal display brightness, said cell re-ignition period being a time period in which a signal is applied to said panel to facilitate return of the panel to normal display brightness.

11. The method of operating a display panel comprising a gas-filled envelope containing at least two arrays of electrodes defining gas-filled cells, at least one array of said electrodes being insulated from the gas and comprising A.C. electrodes, the method comprising causing selected cells to turn on and glow to represent the entry of information in the panel and sustaining the display of this information by the application of sustaining signals to said electrodes, discontinuing the display of information for a period of time, applying special sustainer signals to said panel in a cell-re-ignition period to prepare the panel to be brought to normal display brightness, and applying sustainer signals to said panel to display information contained therein at normal brightness, said sustainer signals comprising a waveform made up of a steady negative sustainer pulse and a pulse inserted therein which rises directly from the negative level of said negative pulse to a positive level and then falls to reference level for a short period and then falls to said negative level.

* * * * *